US011980794B1

(12) United States Patent
Englefield

(10) Patent No.: US 11,980,794 B1
(45) Date of Patent: May 14, 2024

(54) AIMING KEY, PUTTER AND METHOD FOR ENHANCING THE ACCURACY OF AIMING

(71) Applicant: David Sheridan Englefield, Cranleigh (GB)

(72) Inventor: David Sheridan Englefield, Cranleigh (GB)

( * ) Notice: Subject to any disclaimer, the term of this patent is extended or adjusted under 35 U.S.C. 154(b) by 0 days.

(21) Appl. No.: 18/516,791

(22) Filed: Nov. 21, 2023

(51) Int. Cl.
*A63B 53/04* (2015.01)

(52) U.S. Cl.
CPC ..... *A63B 53/0441* (2020.08); *A63B 53/0487* (2013.01)

(58) Field of Classification Search
CPC ..... A63B 53/0441; A63B 53/0487; A63B 69/3629; A63B 69/3676; A63B 69/3685
USPC ..... D21/736, 219, 759, 791
See application file for complete search history.

(56) References Cited

U.S. PATENT DOCUMENTS

| | | | | |
|---|---|---|---|---|
| D248,050 | S | 5/1978 | Muehl | |
| D316,129 | S * | 4/1991 | Bryson | D21/739 |
| 5,350,177 | A * | 9/1994 | Furbush, Jr. | A63B 69/36211 473/409 |
| 5,409,228 | A | 4/1995 | Botsch | |
| D380,801 | S | 7/1997 | Steele | |
| 5,830,078 | A * | 11/1998 | McMahan | A63B 60/02 473/341 |
| 6,159,108 | A | 12/2000 | de la Pena | |
| 6,176,792 | B1 | 1/2001 | Tate | |
| D506,796 | S | 6/2005 | Li | |
| D507,316 | S | 7/2005 | Li | |
| 6,988,955 | B2 | 1/2006 | Stoakes | |
| D518,127 | S | 3/2006 | Tang et al. | |
| D520,583 | S | 5/2006 | Rollinson et al. | |
| D523,915 | S | 6/2006 | Bergstrom | |
| D529,108 | S | 9/2006 | Stites et al. | |
| D531,242 | S | 10/2006 | Adams | |
| D532,067 | S | 11/2006 | Soracco et al. | |
| D533,609 | S | 12/2006 | Moore et al. | |
| D539,860 | S | 4/2007 | Fussell | |
| D542,869 | S | 5/2007 | Adams | |
| D550,795 | S | 9/2007 | Tateno | |
| D559,930 | S | 1/2008 | Cameron | |
| 7,341,526 | B2 | 3/2008 | McCarthy | |
| D569,461 | S | 5/2008 | Morris | |

(Continued)

FOREIGN PATENT DOCUMENTS

| | | |
|---|---|---|
| KR | 20-0341646 | 2/2004 |
| KR | 20-0432095 | 11/2006 |

(Continued)

*Primary Examiner* — Michael D Dennis
(74) *Attorney, Agent, or Firm* — The Law Office of Kevin McDermott, P.L.L.C.

(57) ABSTRACT

A method for enhancing the accuracy of aiming while putting a golf ball with a putter is provided. A head of the putter includes a body having a first end and a second end, the second end includes a target and the first end includes an aiming member extending towards a center of the target. The method includes the steps of focusing on a pointed end of the aiming member and aligning the pointed end with a hole in the ground, executing a backswing while concentrating on moving the pointed end of the aiming member towards the center of the target, executing a forward swing towards the golf ball, and striking the golf ball to translate the golf ball along the alinement towards the hole.

6 Claims, 6 Drawing Sheets

(56) References Cited

U.S. PATENT DOCUMENTS

| | | | | |
|---|---|---|---|---|
| 7,371,184 | B2 | 5/2008 | Tao | |
| D572,780 | S | 7/2008 | Rollinson | |
| D575,366 | S | 8/2008 | Rollinson | |
| D603,008 | S | 10/2009 | Donahue | |
| D619,665 | S | 7/2010 | Rollinson et al. | |
| D620,993 | S | 8/2010 | Laub | |
| D621,462 | S | 8/2010 | Serrano et al. | |
| D629,476 | S | 12/2010 | Serrano et al. | |
| D632,748 | S | 2/2011 | Serrano et al. | |
| D643,486 | S | 8/2011 | Serrano et al. | |
| 8,075,416 | B2 | 12/2011 | Stites et al. | |
| D689,968 | S | 9/2013 | Jones | |
| 8,550,932 | B2 | 10/2013 | Franklin et al. | |
| D704,287 | S | 5/2014 | Tang et al. | |
| D710,470 | S | 8/2014 | Trahan et al. | |
| D741,428 | S | 10/2015 | Wong | |
| D769,993 | S | 10/2016 | Abbott et al. | |
| D777,269 | S | 1/2017 | Becktor et al. | |
| D796,605 | S | 9/2017 | Serrano et al. | |
| D801,458 | S | 10/2017 | Rollinson et al. | |
| D813,963 | S | 3/2018 | Lapuz | |
| 10,293,237 | B1 * | 5/2019 | Hilton | A63B 53/065 |
| D852,300 | S | 6/2019 | Wang et al. | |
| D860,350 | S | 9/2019 | Rollinson | |
| D931,395 | S | 9/2021 | Michelini | |
| D982,686 | S | 4/2023 | Toulon et al. | |
| 2005/0192114 | A1 | 9/2005 | Zider et al. | |
| 2007/0238547 | A1 * | 10/2007 | Jones | A63B 60/02 473/340 |
| 2009/0082123 | A1 * | 3/2009 | Armstrong | A63B 53/0487 473/251 |
| 2010/0083518 | A1 * | 4/2010 | Kramski | A63B 69/3667 33/508 |
| 2010/0323807 | A1 * | 12/2010 | Rha | A63B 53/0487 473/409 |
| 2013/0324277 | A1 * | 12/2013 | Tien | A63B 69/3688 473/249 |

FOREIGN PATENT DOCUMENTS

| | | |
|---|---|---|
| KR | 20-0442499 | 11/2008 |
| KR | 10-1159130 | 6/2012 |

* cited by examiner

AIMING KEY, PUTTER AND METHOD FOR ENHANCING THE ACCURACY OF AIMING

BACKGROUND OF THE INVENTION

This invention relates generally to aiming, and more particularly, to an aiming key, a putter, and a method for enhancing the accuracy of aiming.

Putting may be one of the more difficult and important aspects of golf to master and constitutes a substantial portion of golf scores. Golfers should invest substantial time in putting practice to become better putters, but most golfers do not have the time. It is generally known that most golfers desire to improve their putting.

Putting involves gently swinging the head of a putter across a golfer's body, from one side to another, to gently hit a golf ball in the direction of a hole located in the green. Typically, a golfer aims at the hole using the line etched into his or her putter. After mentally establishing a desired line or path between the face of the putter, the ball and the hole, the golfer gently executes his or her backswing then executes a forward swing across his or her body towards the ball to strike the ball. However, golfers generally do not face the hole and generally do not concentrate on gently hitting the golf ball into the hole while putting. Instead, golfers face the golf ball and concentrate on making contact with the golf ball while putting. As a result, more often than not the golf ball does not follow the desired path so does not go into the hole. The ball may not follow the desired path because the golfer may move the putter off the desired path while gently swinging the putter back away from the ball.

In many competitive games a player is required to aim at an object to establish a desired line of sight. For example, rifle marksmen use a line etched in a scope which is inches from his or her face to aim at an object to establish a desired line of sight. As discussed above, golfers are known to use lines etched in their putters to aim at a hole located in a green to establish a desired line of sight between the putter and the hole. However, this technique typically does not reliably produce the desired result in golf.

Thus, it would be advantageous and an improvement over the relevant technology to provide an aiming key, a putter and a method for enhancing the accuracy of aiming that allows golfers to reliably putt a golf ball into the hole located in the green.

BRIEF DESCRIPTION OF THE INVENTION

In one aspect, an aiming key for enhancing the accuracy of aiming while putting a golf ball is provided. The aiming key includes a body having a pair of parallel sides, a first end, a second end, and an interior opening. The second end includes a target and the first end includes an aiming member extending into the opening and being aimed at a center of the target.

In one embodiment, the target is circular and in another embodiment the target protrudes into the open space.

In another embodiment, the target is circular and has a perimeter, and includes indicia about the perimeter.

In yet another embodiment, the target is circular and is rotatable about the center.

In another embodiment, the interior opening includes a pair of interior parallel sides. Each interior parallel side is offset from a respective parallel side of the body.

In yet another embodiment, the body is made from plastic, aluminum, metal, wood, or a composite including any of these materials.

In another aspect, a putter for enhancing the accuracy of aiming while putting a golf ball is provided. The putter includes a longitudinal shaft having a first end and a second end, and a putter head attached to the second end. The putter head has a front portion and a back portion. The back portion includes a body including a pair of parallel sides, a first end, a second end, and an interior opening. The second end includes a target and the first end includes an aiming member extending into the opening that is aimed at a center of the target.

In an embodiment, the target is circular, square, diamond-shaped, oval or star-shaped.

In another embodiment, the body is made from plastic, aluminum, metal, wood, or a composite including any of these materials.

In yet another embodiment, the target is circular, has a perimeter and includes indicia about the perimeter.

In another embodiment, the target is circular, has a center and is rotatable about the center.

In yet another aspect, a method for enhancing the accuracy of aiming while putting a golf ball with a putter is provided. A head of the putter includes a body having a first end and a second end. The second end includes a target and the first end includes an aiming member extending towards a center of the target. The method includes the steps of focusing on a pointed end of the aiming member and aligning the pointed end with a hole in the ground, executing a backswing while concentrating on moving the pointed end of the aiming member towards the center of the target, executing a forward swing towards the golf ball, and striking the golf ball to translate the golf ball along the alinement towards the hole.

In one embodiment, the target is circular and rotatable about the center and the method further includes rotating the target to a desired position.

DETAILED DESCRIPTION OF THE INVENTION

The following detailed description is made with reference to the accompanying drawings and is provided to assist in a comprehensive understanding of various example embodiments of the present disclosure. The following description includes various details to assist in that understanding, but these are to be regarded merely as examples and not for the purpose of limiting the present disclosure as defined by the appended claims and their equivalents. The words and phrases used in the following description are merely used to enable a clear and consistent understanding of the present disclosure. In addition, descriptions of well-known structures, functions, and configurations may have been omitted for clarity and conciseness. Those of ordinary skill in the art will recognize that various changes and modifications of the example embodiments described herein can be made without departing from the spirit and scope of the present disclosure.

Figure 1:
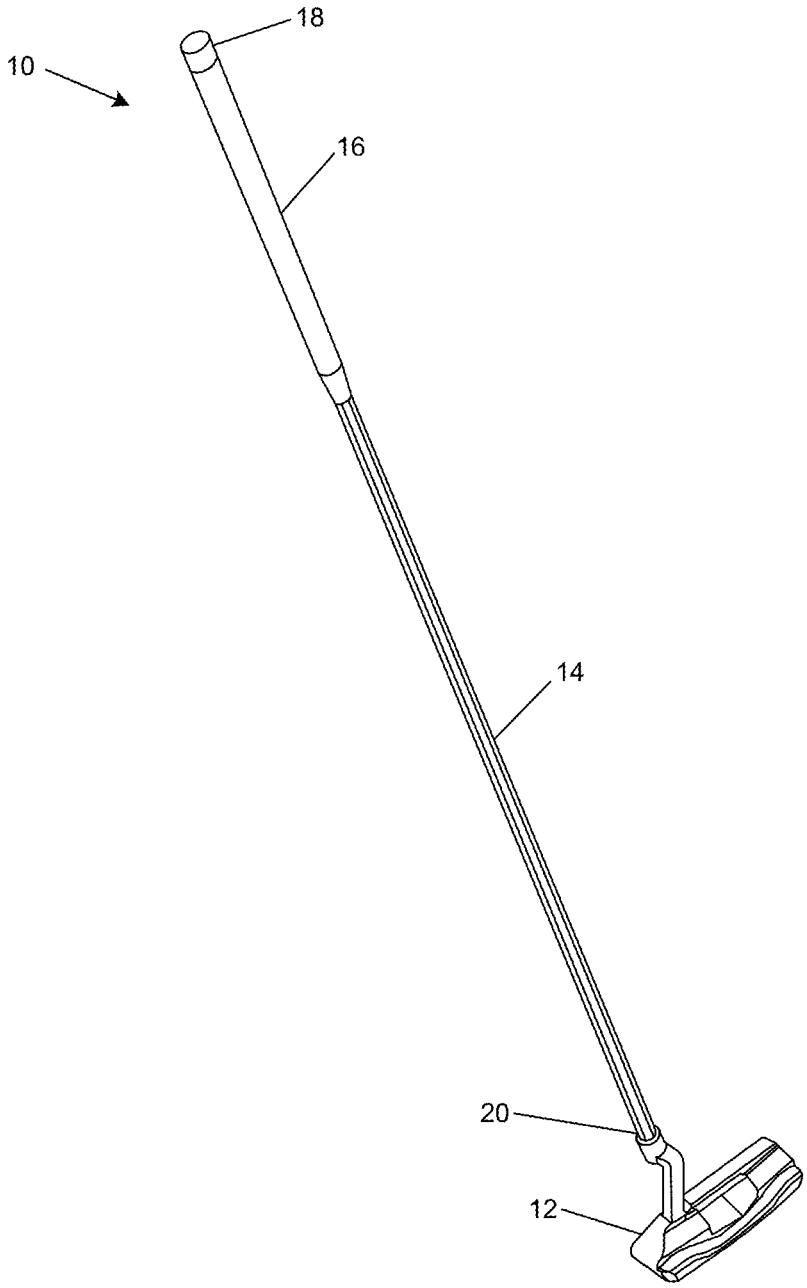
FIG. 1 is a perspective view of an example golf putter.

FIG. 1 is a perspective view of an example golf putter 10. More specifically, the putter 10 includes an example putter head 12, a shaft 14 and a gripping region 16. The putter shaft 14 includes a first end 18 and a second end 20. The putter head 12 may be fixedly attached to either the first 18 or second 20 ends while the gripping region 16 may be attached to the opposite end. The gripping region 16 is for ensuring that golfers are able to securely grasp the putter shaft 14 while putting.

Figure 2:
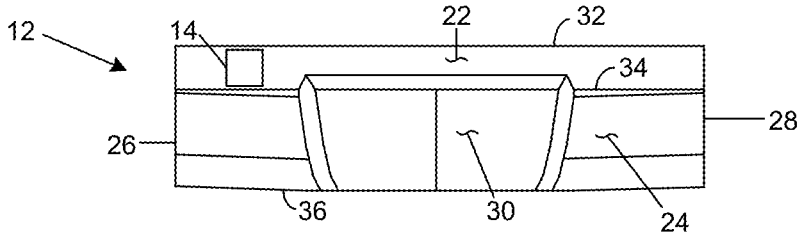
FIG. 2 is an enlarged top view of an example golf putter head included in the golf putter as shown in FIG. 1.

FIG. 2 is an enlarged top view of the example putter head 12 as shown in FIG. 1. More specifically, the head 12 includes a front portion 22, a back portion 24, a heel 26, a toe 28, and a recess 30. The front portion 22 includes a front face 32 and a back face 34. The back portion 24 extends away from the back face 34 to define a rear edge 36 of the back portion 24. The recess 30 extends from the back face 34 to the rear edge 36. The example putter head 12 is a blade type putter head.

Figure 3:
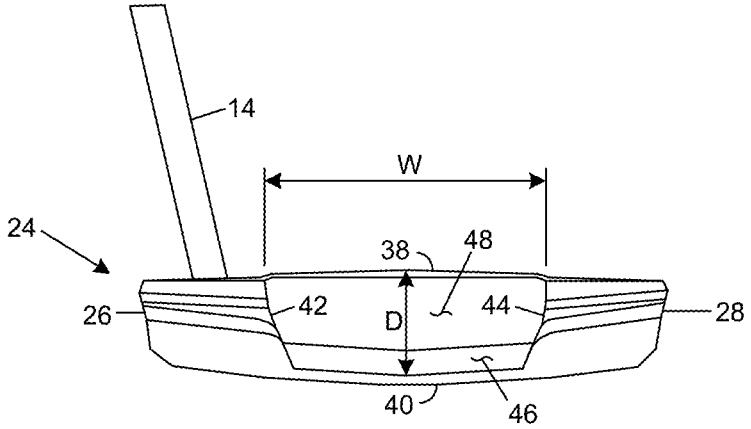
FIG. 3 is an enlarged back view of the example golf putter head as shown in FIGS. 1 and 2.

The example putter head 12 illustrated in FIG. 3 is similar to the putter head illustrated in FIG. 2. As such, features illustrated in FIG. 3 that are identical to features illustrated in FIG. 2 are identified using the same reference numerals used in FIG. 2.

FIG. 3 is an enlarged back view of the example golf putter head 12 as shown in FIGS. 1 and 2, further including a top surface 38 and a bottom surface 40. The height of the putter 12 can be the distance between any point on the top surface 38 and a corresponding point on the bottom surface 40. The recess 30 may have a width W equal to about half the distance from the heel 26 to the toe 28, and may have a depth D approximately equal to the height of the head 12. The recess 30 may have a cross section that resembles a channel, for example, a C-shaped or U-shaped channel. As a result, the recess 30 includes a first side 42, a second side 44, and a bottom 46. The bottom 46 can be flat or can slope from the back face 34 towards the rear edge 36. More specifically, the depth D can be the distance between the bottom 46 of the recess 30 and the top portion 38 of the putter 12.

Figure 4:
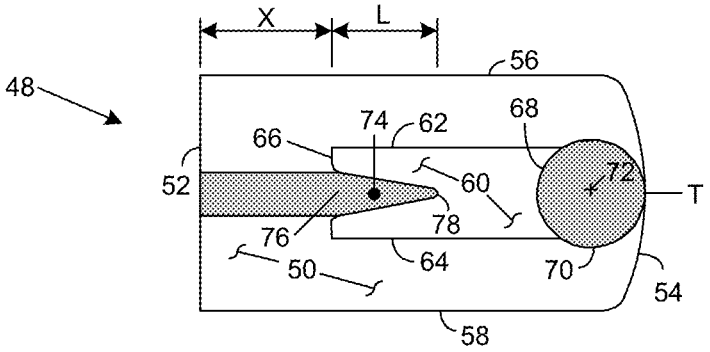
FIG. 4 is a diagram illustrating an example aiming key according to an embodiment of the present disclosure.

FIG. 4 is a diagram illustrating an example aiming key 48 according to an embodiment of the present disclosure. More specifically, the aiming key 48 includes a body 50 having a first end 52, a second end 54, a first side 56 and a second side 58. The first 56 and second 58 sides are parallel to each other while the first end 52 extends between a first end of the first 56 and second sides 58. The first end 52 may be normal to both the first 56 and second 58 sides. The second end 54 can be curved and extends between a second end of the first 56 and second 58 sides. Thus, the aiming key 48 generally resembles a rectangle. However, it is contemplated by the present disclosure that the aiming key 48 may have or resemble any other geometric shape, for example, a square, that facilitates enhancing the accuracy of aiming during putting. Although the second end 54 is described herein as being curved, the second end 54 may alternatively have any shape including, but not limited to, a straight line.

The body 50 may include an opening 60 located in an interior of the body 50 that may extend along a length of the body 50. The opening 60 may have a first interior side 62, a second interior side 64, a first interior end 66, and a second interior end 68. The length of the first 62 and second 64 interior sides can be thirty-four (34) millimeters while the perpendicular distance between the first 62 and second 64 interior sides may be thirteen (13) millimeters. It is contemplated by the present disclosure that the first 62 and second 64 interior sides may alternatively be of any length, and the perpendicular distance between the sides 62, 64 may be any distance that facilitates enhancing the accuracy of aiming while putting as described herein. The distance between the first sides 56 and 62 may be the same as the distance between the second sides 58 and 64. Thus, the opening 60 may be centered between the first 56 and second 58 sides.

The first 62 and second 64 interior sides may be parallel to the first 56 and second 58 sides, respectively. Alternatively, the first 62 and second 64 sides may not be parallel to the sides 56 and 58, respectively. For example, the first 62 and second 64 sides may taper towards each other. The first 62 and second 64 interior sides are shorter than the sides 56 and 58. The opening 60 is generally rectangular. However, the opening 60 may alternatively be, or generally resemble any other shape, for example, a square or oval.

The body 50 may also include a circular target 70 that may be positioned at or proximate the second end 54 of the body 50. The target 70 may be positioned to extend from the second end 54 into the opening 60. Moreover, the perimeter of the target 70 may be coincident with the second end 54 at a point of tangency T common to the target 70 and the second end 54. Alternatively, the perimeter of the target 70 may not be coincident with the second end 54. Rather, the perimeter of the target 70 may be offset from the end 54 by any distance, for example, one (1) millimeter.

It is contemplated by the present disclosure that the perimeter of the target 70 may define the shape of the second interior end 68. Thus, the shape of the second interior end 68 may be an arc defined by the perimeter of the circular target 70. The target 70 has a center 72 and may be an integral part of the body 50 or may be fixedly attached thereto. The overall length of the aiming key 48 as measured from the first end 52 to the point T can be sixty-six (66) millimeters, and the overall width measured as the length of the first end 52 may be thirty-five (35) millimeters. Alternatively, the overall length and overall width may be any distance that facilitates enhancing the accuracy of aiming as described herein.

The aiming key 48 also includes an aiming member 74. The aiming member 74 has a base 76 positioned in the middle of the first interior end 66 and extends a distance L away from the interior end 66 into the opening 60. The distance L is measured perpendicular to the first interior end 66. The aiming member 74 tapers over the distance L to an end 78. The end 78 may be rounded or pointed. The aiming member 74 is oriented to point directly at the center 72 of the target 70. The distance L may be one and six tenths (1.6) centimeters or any length that facilitates enhancing the accuracy of aiming as described herein. A distance X between the first end 52 and the first interior end 66 can be one and nine tenths (1.9) centimeters. Alternatively, the distance X can be any distance that facilitates enhancing the accuracy of aiming as described herein. The base 76 may be one-quarter of an inch (¼"). However, the base 76 may alternatively have any width that facilitates enhancing the accuracy of aiming as described herein.

The target 70 and the aiming member 74 are shaded. The shading for the aiming member 74 extends from the end 78 to the base 76. The shading also extends from the base 76 to the first end 52 of the aiming key 48. The shading extending from the base 76 to the first end 52 can be the same width as the base 76. Alternatively, the shading from the base 76 to the end 52 may be any width or may extend in any manner between the base 76 and the end 52.

The shading represents a surface treatment, for example, paint or a sticker applied to the aiming key 48. The surface treatment may be any color or design. Stickers may be attached to the aiming key 48 using adhesive. Paint may be applied to the aiming key 48 in any manner, for example, using a brush or screen printing. The shading between the first interior end 66 and the first end 52 functions to visually lengthen the aiming member 74 such that golfers perceive the aiming member 74 as extending from the first end 52 to the end 78. This visual effect helps golfers to aim at a hole in the green and to concentrate on the relationship between the aiming member 74 and the target 70 while putting, to thus facilitate hitting a golf ball along a desired alinement or path into the hole.

The aiming key 48 may be made of plastic, aluminum, steel, wood, any other type of metal, graphite, or a composite of any of these materials.

The information shown in FIGS. 5-11 is the same information as shown in FIG. 4, as described in more detail below. As such, components illustrated in FIGS. 5-11 that are identical to components illustrated in FIG. 4, are identified using the same reference numerals used in FIG. 4.

Figure 5:
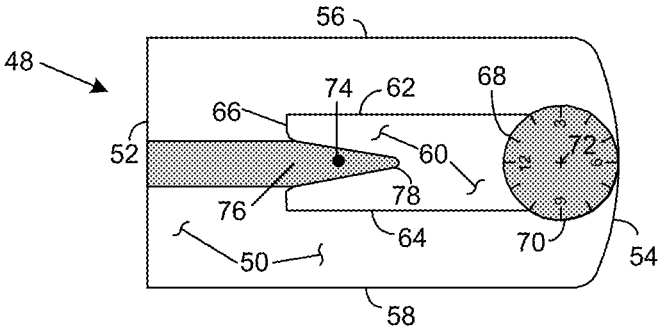
FIG. 5 is a diagram illustrating the example aiming key as shown in FIG. 4, wherein an example target in the aiming key is rotatable.

FIG. 5 is a diagram illustrating the example aiming key 48 as shown in FIG. 4. However, the target 70 is rotatable. For example, the target 70 may be a rotatable dial. The rotatable target 70 may be mounted to the body 50 using any arrangement that allows the target 70 to rotate about the center 72 and at the same time be securely fixed to the aiming key 48. The rotatable target 70 may have indicia thereon similar to the face of a clock. Twelve o'clock may be oriented such that the aiming member 74 points directly at twelve o'clock as well as at the center 72 of the target 70. Alternatively, the target 70 may have any indicia thereon that facilitates enhancing the accuracy of aiming while putting as described herein. The indicia may be applied to the target 70, for example, as paint or as a sticker.

The target 70 may be rotated in a manner that causes the aiming member 74 to point directly at a different time as well as the center 72 of the target 70. For example, the target 70 may be rotated such that the aiming member 74 points directly at ten o'clock as well as at the center 72 of the target 70.

Figure 6:
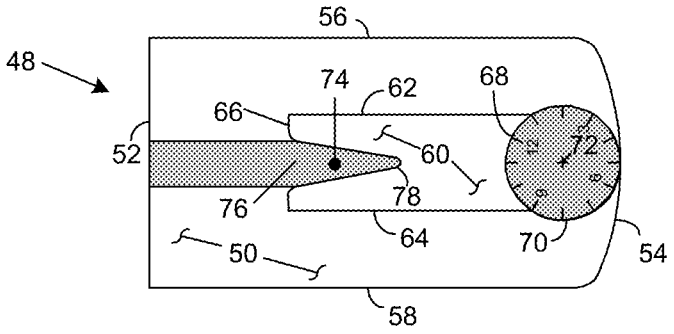
FIG. 6 is a diagram illustrating the example aiming key as shown in FIG. 5; however, the example target has been rotated into a different position.

FIG. 6 is a diagram illustrating the example aiming key 48 as shown in FIG. 5. However, the target 70 has been rotated into a different position. More specifically, the target 70 has been rotated such that the aiming member 74 points directly at eleven o'clock and at the center 72 of the target 70.

Although the target 70 is circular in the examples described herein, it is contemplated by the present disclosure that the target 70 may have any shape that facilitates manipulating the putter head 12 to accurately aim the putter head 12 to strike a golf ball so the golf ball travels along an alinement, or a desired path and into the hole in a green. For example, the target 70 may alternatively be star-shaped, diamond-shaped, square, rectangular, or oval. The alinement, or desired path may be, for example, a straight line, curvilinear, or a combination of straight and curvilinear.

Figure 7:
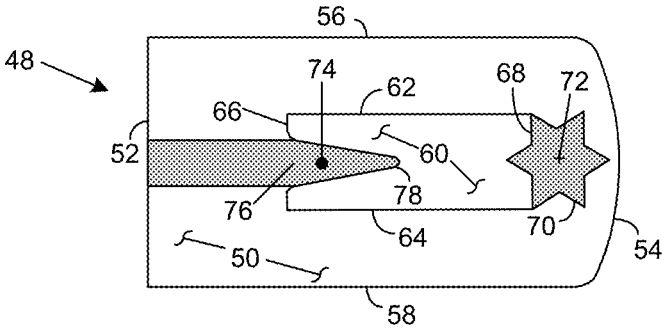
FIG. 7 is a diagram illustrating the example aiming key 48 as shown in FIG. 4; however, the target is star-shaped.

FIG. 7 is a diagram illustrating the example aiming key 48 as shown in FIG. 4. However, the target 70 is star-shaped and is offset from the second end 54.

Figure 8:
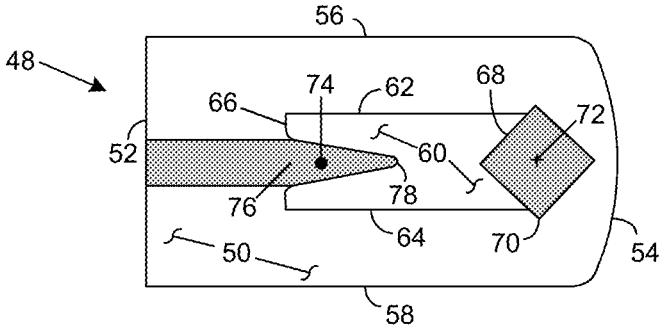
FIG. 8 is a diagram illustrating the example aiming key as shown in FIG. 4; however, the target is diamond-shaped.

FIG. 8 is a diagram illustrating the example aiming key 48 as shown in FIG. 4. However, the target 70 is diamond-shaped and is offset from the second end 54.

Figure 9:
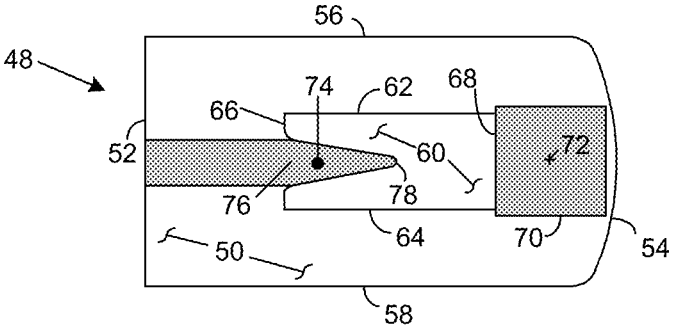
FIG. 9 is a diagram illustrating the example aiming key as shown in FIG. 4; however, the target is square.

FIG. 9 is a diagram illustrating the example aiming key 48 as shown in FIG. 4. However, the target 70 is square and is offset from the second end 54.

Figure 10:
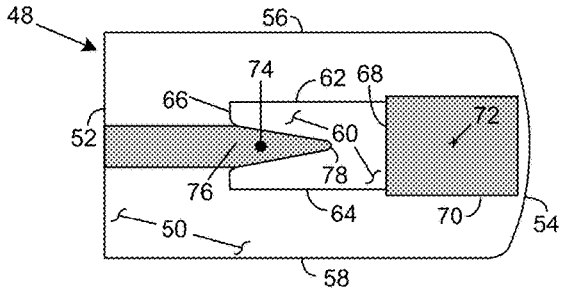
FIG. 10 is a diagram illustrating the example aiming key as shown in FIG. 4; however, the target is rectangular.

FIG. 10 is a diagram illustrating the example aiming key 48 as shown in FIG. 4. However, the target 70 is rectangular and is offset from the second end 54.

Figure 11:
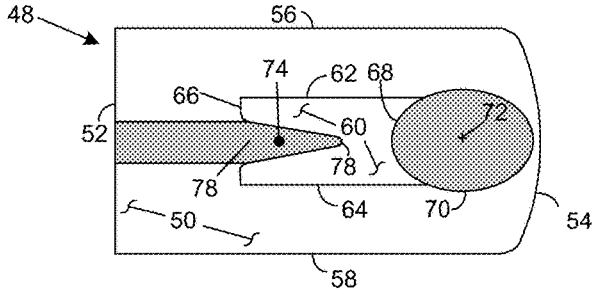
FIG. 11 is a diagram illustrating the example aiming key as shown in FIG. 4; however, the target is oval.

FIG. 11 is a diagram illustrating the example aiming key 48 as shown in FIG. 4. However, the target 70 is oval and is offset from the second end 54.

It is contemplated by the present disclosure that each of the example targets 70 as shown in FIGS. 5-11 may alternatively extend to the second end 54.

Figure 12:
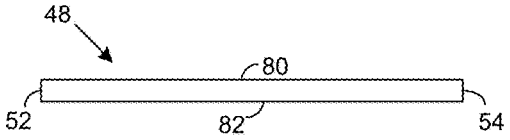
FIG. 12 is a diagram illustrating a side view of the aiming key.

FIG. 12 is a diagram illustrating a side view of the aiming key 48. More specifically, the aiming key 48 includes a top surface 80 and a bottom surface 82. The thickness of the aiming key 48 is measured as the distance between the top 80 and the bottom 82 surfaces. The thickness can be, for example, ten (10) millimeters. Alternatively, the thickness of the aiming key 48 can be any thickness, for example, the distance D between the top 38 and bottom 40 surfaces, that facilitates enhancing the accuracy of aiming while golfing as described herein.

Figure 13:
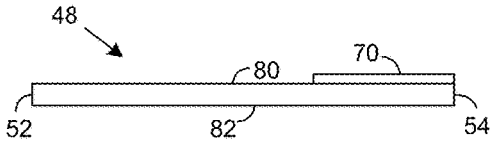
FIG. 13 is a diagram illustrating the side view of the aiming key as shown in FIG. 12, further including a rotatable target mounted on a top surface of the aiming key.

FIG. 13 is a diagram illustrating the side view of the aiming key 48 as shown in FIG. 12, further including the rotatable target 70 mounted on the top surface 80.

Putting involves gently swinging the head of a putter across a golfer's body, from one side to another, to gently hit a golf ball in the direction of the hole located in the green. Typically, a golfer aims at the hole using the line etched into his or her putter. After mentally establishing a desired alinement or path between the face of the putter, the ball and the hole, the golfer gently executes a backswing then executes a forward swing across his or her body towards the ball to strike the ball. However, golfers generally do not face the hole and generally do not concentrate on gently hitting the golf ball into the hole while putting. Instead, golfers face the golf ball and concentrate on making contact with the golf ball while putting. As a result, more often than not the golf ball does not follow the desired path so does not go into the hole.

The ball may not follow the desired path because the golfer may move the putter off the desired alinement or path while executing his or her backswing. More specifically, while executing his or her backswing the golfer may move the head 12 in a curve or in any other manner that diverges from the desired alinement. Thus, when the head 12 strikes the golf ball it does not move along the desired alinement into the hole.

To address these problems a method for enhancing the accuracy of aiming while putting a golf ball can be implemented using a putter that includes an aiming key. The head 12 of the putter 10 can include the aiming key. The aiming key includes a body having a first end and a second end. The second end includes a target and the first end includes an aiming member extending towards a center of the target. The method for enhancing the accuracy of aiming while putting a golf ball can include focusing on the end of the aiming member and aligning the end with a hole in the ground, executing a backswing while concentrating on moving the end of the aiming member towards the center of the target, executing a forward swing towards the golf ball, and striking the golf ball to translate the golf ball along the alinement towards the hole.

Figure 14:
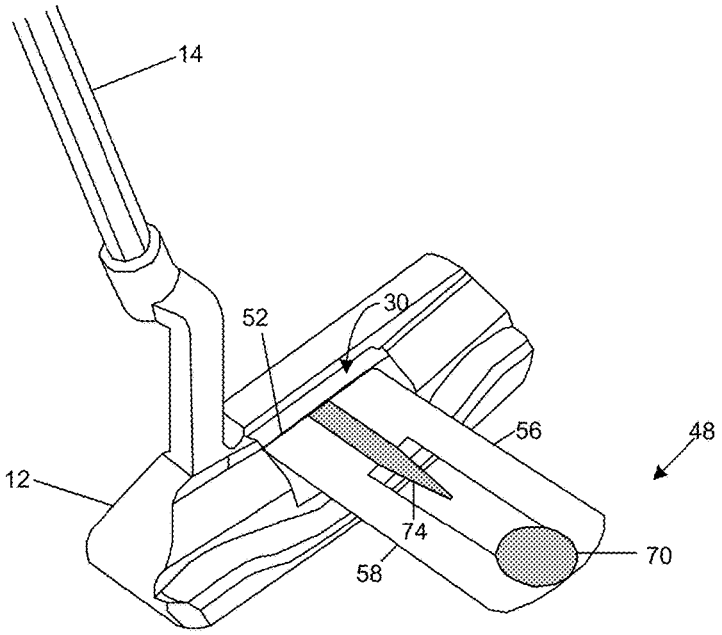
FIG. 14 is a diagram illustrating an enlarged perspective view of the putter head with an aiming key positioned in a recess in the putter head.

FIG. 14 is a diagram illustrating an enlarged perspective view of the putter head 12 with the aiming key 48 positioned in the recess 30. The aiming key 48 may be positioned in the recess 30 such that the first end 52 of the aiming key 48 is positioned against the back face 34 of the front portion 22, and the sides 56 and 58 are each positioned against a respective side 42 or 44 of the recess 30. Alternatively, the aiming key 48 may be positioned in the recess 30 such there can be a gap between the first end 52 and the back face 34, and/or between the sides 56 and 58 and a respective side 42 or 44. The gap may be, for example, one (1) millimeter but alternatively may be any distance that facilitates securely attaching the aiming key 48 to the recess 30 while also facilitating enhancing the accuracy of aiming as described herein. Positioning the aiming key 48 in the recess 30 facilitates enhancing the accuracy of putting a golf ball into a hole in a green using the putter 10.

The bottom surface 82 of the aiming key 48 can be attached to the bottom surface 46 of the recess 30 using, for example, Velcro. Alternatively, the aiming key 48 can be attached to the bottom surface 46 in any manner including, but not limited to, welding. Because the aiming key 48 may be attached to the recess 30 using Velcro, the aiming key 48 can be removed from the putter. Thus, the aiming key 48 may be removably attached to the putter 10. Instead of attaching the aiming key 48 to the head 12 after manufacturing, it is contemplated by the present disclosure that the aiming key 48 may be included as part of the head 12 during manufacture such that the aiming key 48 is an integral part of the putter head 12.

Figure 15:
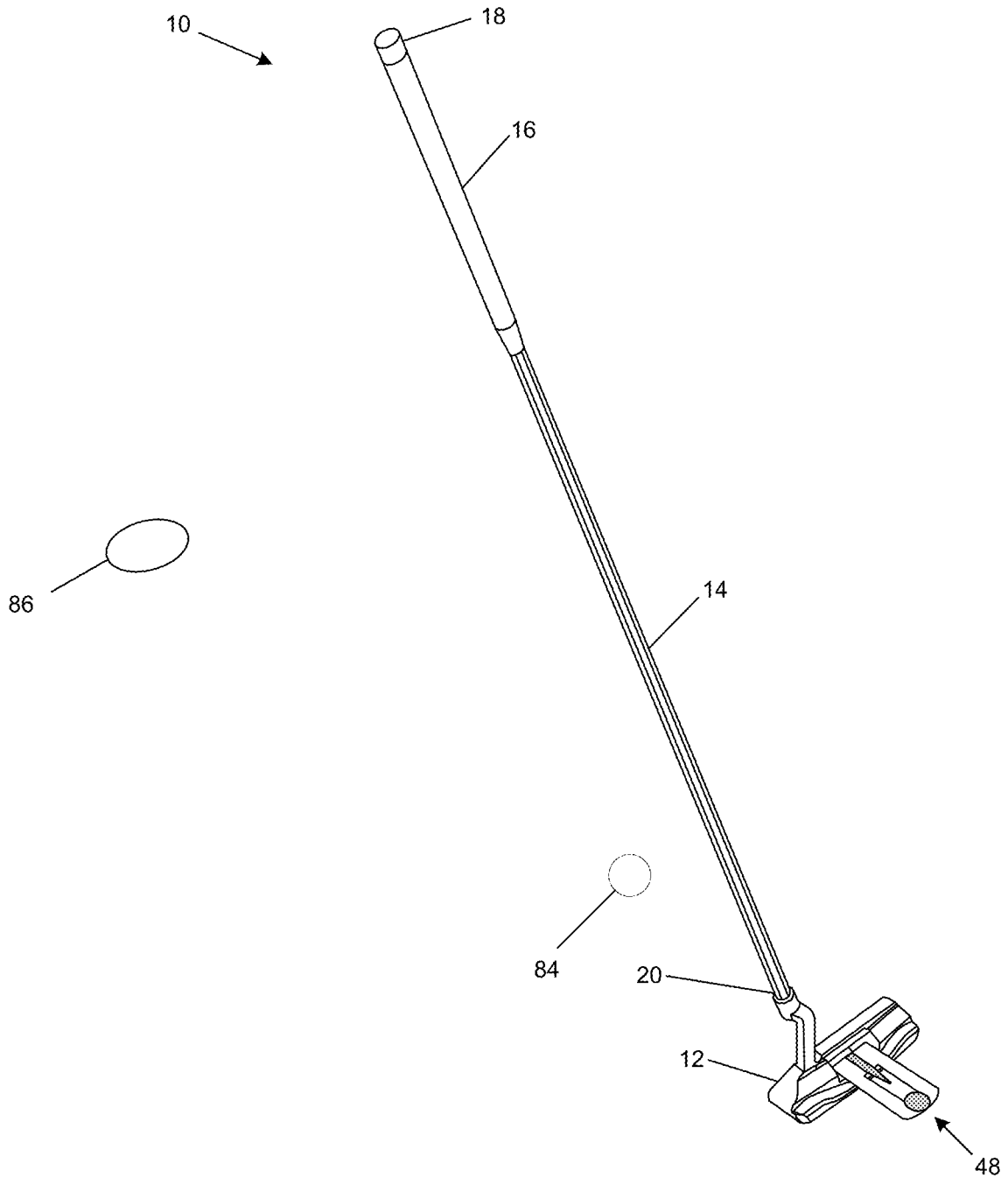
FIG. 15 is a diagram illustrating the putter in which the head includes the aiming key while the putter is used to execute a putt.

FIG. 15 is a diagram illustrating the putter 10 in which the head 12 includes the aiming key 48 while the putter 10 is used to execute a putt by hitting a golf ball 84 into a hole 86 in a green. More specifically, a golfer maneuvers the putter 10 about the ball 84, focusses on the end 78 of the aiming member 74 and aligns the end 78 with the hole 86 to establish a desired alinement or path. Next, the golfer gently executes his or her backswing while concentrating on moving the end 78 towards the center 72 of the target 70. Doing so facilitates causing the golfer to swing the putter 10 along the desired alinement during the forward swing. As a result, a golfer's aim and putting accuracy are facilitated to be enhanced.

Frequently while executing his or her backswing using a putter 10 including the aiming key 48, a golfer may move the head 12 in a manner that diverges from the desired alinement. The aiming key 48 as shown in FIGS. 5 and 6 that includes a rotatable target 70 may be used to facilitate reducing divergence from the desired alinement. For example, the target 70 may be oriented such that twelve o'clock lies on the line between the aiming member 74 and the center 72 of the target 70. When there is divergence from the desired alinement during the backswing, the target 70 can be rotated to account for the divergence. For example, the target 70 can be rotated such that eleven o'clock lies on the line between the aiming member 74 and the center 72 of the target 70. Thus, while concentrating on moving the end 78 of the aiming member 74 towards the center 72 of the target 70 during the backswing, the golfer will automatically correct his or her swing such that the putter head 12 is facilitated to be swung along the desired alinement during the forward swing.

It is contemplated by the present disclosure that rotation of the target 70 may be proportional to the divergence from a desired alinement. Thus, a large divergence warrants a large rotation while a small divergence warrants a small rotation. For example, a large divergence may warrant rotating the target three (3) increments so that three o'clock lies on the line between the aiming member 74 and the center 72 of the target 70. A small divergence may warrant rotating the target 70 one increment so eleven o'clock lies on the line between the aiming member 74 and the center 72 of the target 70.

Although the example putter head 12 described herein is a blade type putter head, it is contemplated by the present disclosure that the putter head 12 may be any type of putter head, including, but not limited to, a mallet type putter head.

Figure 16:
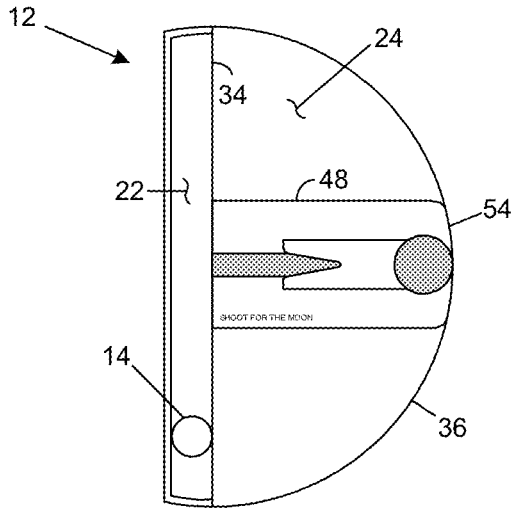
FIG. 16 is an enlarged top view of an alternative example golf putter head that can be included in the golf putter as shown in FIG. 1.

FIG. 16 is an enlarged top view of an alternative example golf putter head 12 that can be included in the golf putter 10 as shown in FIG. 1. The alternative golf putter head 12 is a mallet type putter head. Thus, the golf putter 10 can include the mallet type putter head 12 instead of the blade type putter head as shown in FIGS. 1, 14 and 15.

The mallet type putter head 12 includes the front portion 22 that includes the back face 34, and the back portion 24 extending away from the back face 34 to define the rear edge 36. However, the back portion 24 does not include the recess 30 and the rear edge 36 is curved. The rear edge 36 may be any type of curve including, but not limited to, a semicircle. Alternatively, the rear edge 36 may have any other geometric shape such as, but not limited to, rectangular, square, and triangle. Although the back portion 24 does not include the recess 30, the aiming key 48 may be attached to the back portion 24 using Velcro or may be welded to the back portion 24 to facilitate enhancing the accuracy of aiming while golfing as described herein. The aiming key 48 may alternatively be manufactured with the mallet type putter head 12 to be integral with the mallet type putter head 12.

It is contemplated by the present disclosure that the second end 54 of the aiming key 48 may have the same shape as the rear edge 36 such that the second end 54 is coincident with the rear edge 36. Thus, the second end 54 of the aiming key 48 may be any shape including, but not limited to, semicircular, oval, rectangular, and triangular that matches the shape of the rear edge 36.

Figure 17:
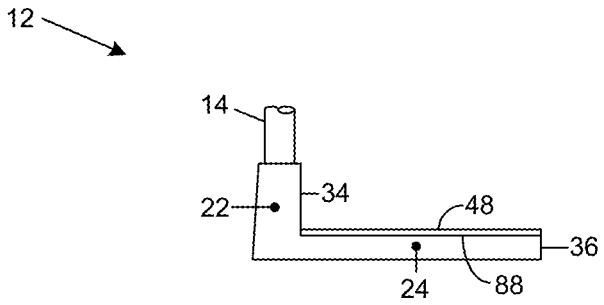
FIG. 17 is a side view of the alternative example golf putter head as shown in FIG. 16.

FIG. 17 is a side view of the mallet type putter head 12 as shown in FIG. 16. More specifically, the aiming key 48 is attached to a top surface 88 of the back portion 24 of the mallet type putter head 12.

Although the example putter head 12 is described herein as a blade type putter head and a mallet type putter head, it is contemplated by the present disclosure that the putter head 12 may be any type of putter head including variations of the blade and mallet type putter heads described herein to which the aiming key 48 can be attached to facilitate enhancing the accuracy of a golfer's aim during putting.

The aiming key 48, putter 10 and method of putting as described herein facilitate quickly enhancing a golfer's aim and thus the accuracy of putting for any golfer including professionals and amateurs. As a result, the number of putts required to navigate the golf ball into the hole is facilitated to be reduced and golfers have more time to work on other areas of their golf games that they may enjoy more than putting. Accordingly, golfer performance and competitiveness are both facilitated to be enhanced.

The above description provides examples, and is not limiting of the scope, applicability, or configuration set forth in the claims. Changes may be made in the function and arrangement of elements discussed without departing from the spirit and scope of the disclosure. Various embodiments may omit, substitute, or add various features as appropriate. For instance, features described with respect to certain embodiments may be combined in other embodiments.

What is claimed is:

1. A putter for enhancing the accuracy of aiming while putting a golf ball comprising:

a longitudinal shaft having a first end and a second end; and a putter head attached to the second end of the longitudinal shaft, the putter head having a front portion and a back portion, wherein:

the back portion includes a body comprising a pair of parallel sides, a first end, a second end, an interior opening, and an aiming member;

the interior opening includes a first interior end, a second interior end including a target, and a width, the target protrudes into the interior opening; and the aiming member includes a triangular portion extending into the interior opening aimed at a center of the target and a rectangular portion extending from the first interior end to the first end, a base of the triangular portion has a width less than the interior opening width and the rectangular portion has the same width as the base.

2. The putter according to claim 1, wherein the target is circular, square, diamond-shaped, oval or star-shaped.

3. The putter according to claim 1, wherein the body is made from plastic, aluminum, metal, wood, or a composite including any of these materials.

4. The putter according to claim 1, wherein the target is circular, has a perimeter and includes indicia about the perimeter.

5. The putter according to claim 1, wherein the target is circular, has a center and is rotatable about the center.

6. The putter according to claim 1, wherein the triangular portion of the aiming member comprises:

the base coincident with the first interior end; and two sides that taper to an end aimed at the center of the target.

* * * * *